United States Patent [19]

Kirby

[11] 4,101,821

[45] Jul. 18, 1978

[54] VARIABLE PHASE SHIFTING APPARATUS

[75] Inventor: Thomas J. Kirby, Pelham, N.H.

[73] Assignee: GTE Sylvania Incorporated, Stamford, Conn.

[21] Appl. No.: 792,509

[22] Filed: May 2, 1977

[51] Int. Cl.[2] ..... G05F 1/68

[52] U.S. Cl. ..... 323/119; 328/55; 328/155; 323/128; 323/122

[58] Field of Search ..... 323/101, 108, 121, 122, 323/125, 119, 128; 328/155, 55

[56] References Cited

U.S. PATENT DOCUMENTS

| | | | |
|---|---|---|---|
| 3,130,362 | 4/1964 | MacMillan | 323/128 |
| 3,418,418 | 12/1968 | Wilder | 323/119 |
| 3,612,916 | 10/1971 | O'Neill | 323/119 |
| 4,039,930 | 8/1977 | Lukas | 323/108 |

*Primary Examiner*—Gerald Goldberg
*Attorney, Agent, or Firm*—David M. Keay

[57] ABSTRACT

Variable phase shifting apparatus for selectively altering the phase of an AC signal. The signal is conducted through a series of stages. Each stage includes an operational amplifier having an input resistor and a feedback resistor. A capacitor is associated with either the input resistor or with the feed-back resistor. The capacitor may be connected into or disconnected from the stage by a digital switch. When the capacitor is connected, the stage produces a particular amount of shift in the phase of the AC signal, and when the capacitor is disconnected, the AC signal is conducted through the stage with no change in phase. By employing stages capable of producing different amounts of phase shift any of a set of amounts of phase shifts may be obtained.

13 Claims, 3 Drawing Figures

VARIABLE PHASE SHIFTING APPARATUS

BACKGROUND OF THE INVENTION

This invention relates to apparatus for shifting the phase of an AC signal. More particularly, it is concerned with phase shifting apparatus in which the amount of the phase shift is variable in predetermined amounts.

The phase of an AC signal may be shifted in various ways. The signal may be conducted through lengths of transmission line or delay lines or may be processed by digital phase shifting circuitry. These elements may be employed in arrangements which permit varying the amount of phase shift obtained. However, known techniques utilizing elements of the foregoing type involve problems of physical size, difficulties in preserving the amplitude information of the AC signal, and problems in precisely controlling the phase shift over a wide range.

SUMMARY OF THE INVENTION

Variable phase shifting apparatus in accordance with the present invention permits precise control of the amount of phase shift over a wide range while preserving the amplitude information of the signal. The apparatus includes an input terminal for receiving an AC signal and an output terminal. A plurality of signal conducting means are connected in series between the input terminal and the output terminal in order to conduct an AC signal received at the input terminal to the output terminal. Each of the signal conducting means includes a circuit means, a phase shifting means, and a switching means. When in a first state, the switching means connects the phase shifting means to the circuit means and when in a second state, the switching means disconnects the phase shifting means from the circuit means. The signal conducting means produces a predetermined phase shift in an AC signal being conducted therethrough when the switching means is in the first state connecting the phase shifting means to the circuit means. Switch control means are coupled to each of the switching means of the plurality of signal conducting means. The switch control means selectively switches each of the switching means to either the first or the second state thereby providing the desired amount of phase shift in the signal at the output terminal with respect to the signal received at the input terminal.

BRIEF DESCRIPTION OF THE DRAWINGS

Additional objects, features, and advantages of variable phase shifting apparatus in accordance with the present invention will be apparent from the following detailed discussion together with the accompanying drawings wherein.

DETAILED DESCRIPTION OF THE INVENTION

Figure 1:
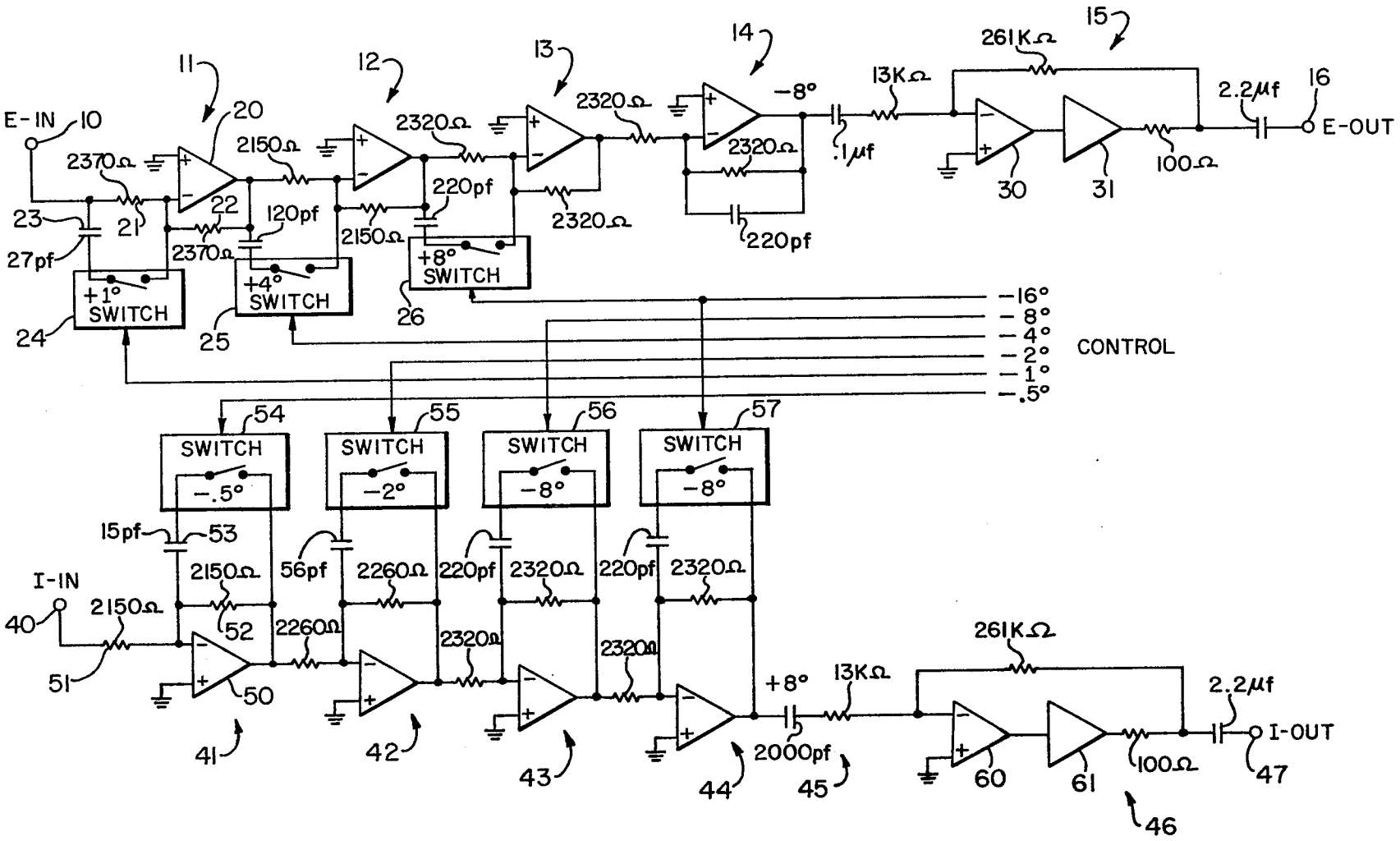
FIG. 1 is a schematic diagram of variable phase shifting apparatus in accordance with the present invention for controlling the phase relationship between two AC signals.

FIG. 1 is a schematic diagram of a variable phase shifter which may be employed in apparatus for controlling the RF power delivered to a load as disclosed and claimed in copending application Ser. No. 792,510 filed May 2, 1977 by Thomas J. Kirby entitled "RF Power Control Apparatus" and assigned to the assignee of the present invention. The apparatus of FIG. 1 is employed to adjust the phase relationship between two AC signals E and I which may be vector signals representing the instantaneous values of voltage and current, respectively, in an RF signal. The variable phase shifter permits variable control of the phase offset between the two signals E and I while maintaining the instantaneous amplitude relationship existing between the two signals.

For each signal E and I the apparatus employs a plurality of controllable phase shifting elements or stages connected in series. The amounts of phase shift which may be obtained from the stages are binarily related so as to provide a set of possible amounts of phase shift which are individually small but cover a wide range. The basic elements of each stage are an operational amplifier with feedback, a capacitor which together with a resistor forms an RC phase shifting network, and a digital switch by which the capacitor is selectively connected to or disconnected from the other elements of the stage. A stage produces a particular amount of shifting of the phase of the signal being conducted when the capacitor is connected so as to provide a functioning RC phase shifting network.

In a particular embodiment of the variable phase shifting apparatus of the invention, the E and I signals being processed are at a frequency of 43555.55 Hz. As explained in the aforementioned copending application this signal may be an IF signal of any convenient frequency derived from a sampled RF signal.

In the apparatus illustrated in FIG. 1 the E signal is applied to an input terminal 10 and conducted in series through four phase shifting stages 11, 12, 13, and 14 and an output amplifier 15 to an output terminal 16. The first three stages 11, 12, and 13 are individually controllable to produce either no shift in the phase of the E signal or particular amounts of phase shift. The fourth stage 14 shifts the phase of the E signal by a fixed amount. The output amplifier 15 produces a fixed gain of the E signal and does not alter its phase.

The first stage 11 of the series includes an operational amplifier 20, specifically type CA747. The plus input of the amplifier 20 is connected directly to ground and the minus input is coupled to the input terminal 10 by way of an input resistor 21. A feedback resistor 22 is connected between the output and the minus input of the operational amplifier. An input capacitor 23 and a digitally controlled switch 24 are connected in series across the input resistor 21.

Under operating conditions when the switch 24 is in the open condition, the E signal passes through the stage with no change in phase. The stage is designed to produce unity gain of the E signal. When the digital signal switch 24 is in the closed condition, the capacitor 23 is connected in parallel with the input resistor 21 causing the phase of the E signal to be shifted. As indicated in FIG. 1 in the specific embodiment illustrated closing switch 24 causes the phase of the E signal to be shifted by $+1°$; that is, the output leads the input by $1°$.

Stages 12 and 13 are similar to stage 11, but with appropriate values of components such that when their respective digital switches 25 and 26 are closed, they produce phase shifts of $+4°$ and $+8°$, respectively, in the E signal. In the fourth stage 14 a capacitor is connected in parallel with the feedback resistor. The fourth stage therefore shifts the phase of the E signal passing through the stage causing the output to lag the input by a fixed amount. In the specific embodiment shown the fourth stge 14 introduces a −8° phase shift as indicated. The output amplifier 15 employs a combination of an operational amplifier 30, type CA3100, and an amplifier 31, type LH0002, arranged as shown. The fourth phase shifting stage 14 is coupled to the output amplifier 15 by way of a capacitor-resistor circuit which introduces no significant change in the phase of the E signal.

The I signal is applied to an input terminal 40 and is conducted through four controllable phase shifting stages 41, 42, 43, and 44 and an output amplifier 46 having an input circuit 45 causing a fixed phase shift to an output terminal 47. The first stage 41 of the series includes an operational amplifier 50, specifically type CA747. The plus input of the amplifier 50 is connected directly to ground and the minus input is coupled to the input terminal 40 by way of an input resistor 51. A feedback resistor 52 is connected between the output of the amplifier 50 and its minus input. A feedback capacitor 53 and a digital switch 54 are connected in series across the feedback resistor 52. When the switch 54 is open, the stage 41 acts as a unity gain amplifier with no change in the phase of the I signal being conducted therethrough. When the switch 54 is closed and the capacitor 53 is connected into the circuit, the stage causes a −0.5° shift in the phase of the I signal. That is, the I signal at the output of the stage lags the signal at the input by .5°.

The second, third, and fourth stages 42, 43, and 44 are similar to stage 41. Each stage 42, 43, and 44 includes a digital switch 55, 56, and 57, respectively, for selectively switching its associated feedback capacitor into and out of its feedback circuit. The three stages produce phase shifts of −2°, −8°, and −8°, respectively. That is, they all cause the output to lag the input signal.

The output of the fourth stage 44 is coupled by a series combination 45 of input capacitor and resistor to the output amplifier 46. The output amplifier 46 includes an operational amplifier 60, specifically type CA3100, in series with an amplifier 61, specifically type LH0002. A resulting phase shift of +8° (output leads input) is obtained.

Control lines are connected to the digital switches 24, 25, 26, 54, 55, 56, and 57 as shown. The switches respond to binary CONTROL signals on the control lines. Typically, a logic 1 causes the switch to open, and a logic 0 causes the switch to close. When a logic 1 CONTROL signal is present on all the control lines and all the digital switches are open, a −8° phase shift or lag of 8° is produced in the E signal by fixed stage 14. At the same a +8° phase shift or lead of 8° is produced in the I signal by the fixed arrangement 45. That is, the phase offset between the I and E signals at the output terminals 47 and 16 differs from the phase offset at the input terminals 40 and 10 by +16°. (+ indicates a shift in the lead direction of the I signal with respect to the E signal, and — indicates a shift in the lag direction of the I signal with respect to the E signal).

By logic 0 CONTROL signals on the control lines as indicated "−" amounts of phase shift may be obtained from the +16° shift of all logic 1's. For example, a logic 0 CONTROL signal on the line designated −16° closes switches 26 and 57. The net result is that neither the E signal nor the I signal is shifted in phase and the phase relationship between the two signals is unaltered. By selectively applying logic 1 and 0 CONTROL signals to the control lines the phase offset of the I current with respect to the E current at the output terminals can be varied from that at the input terminal over a range of +16° to −15.5° in incremental amounts of 0.5°.

Figure 2:
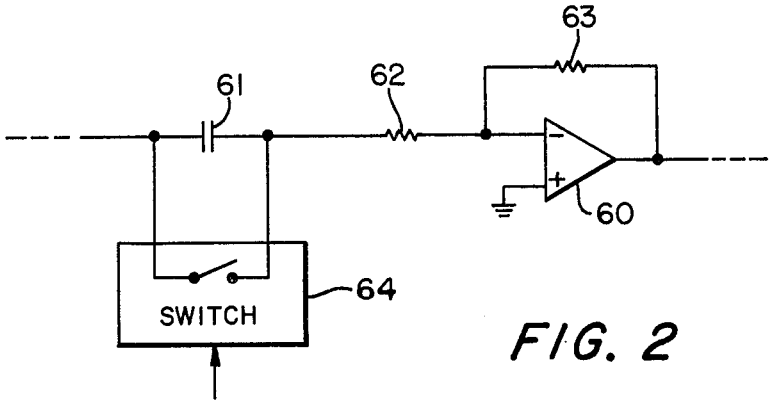
FIG. 2 is a schematic diagram utilizing a modified version of a stage of the apparatus of FIG. 1.

In the stages shown in FIG. 1 the capacitors are connected in parallel with resistors to form RC phase shifting networks. FIG. 2 illustrates a modified stage which may be employed in a phase shifter in which the RC phase shifting network is formed by a capacitor and resistor in series. As illustrated in FIG. 2 an operational amplifier 60 has its plus input connected directly to ground and its minus input connected to an input arrangement of a capacitor 61 and a resistor 62 in series. A feedback resistor 63 is connected between the output and minus input of the amplifier. A digital switch is connected across the capacitor 61. Thus, when the switch 64 is in an open condition, the capacitor 61 is part of the circuit and a phase shift is produced by the stage. When the switch 64 is in the closed condition, the capacitor 61 is bypassed and the stage does not produce a shift in the phase of the signal passing therethrough. In a similar manner, a capacitor may be connected and disconnected from a capacitor-resistor series feedback circuit. Although in the specific embodiments shown and described capacitors have been employed as the phase shifting elements, other reactance elements, specifically inductors, may be employed for this function. Inductors produce a phase lag where capacitors produce a lead and produce a lead where capacitors produce a lag.

Figure 3:
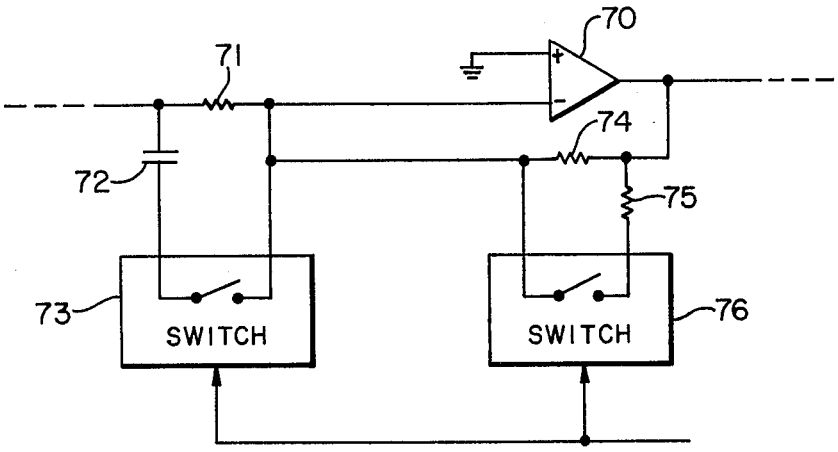
FIG. 3 is a schematic diagram illustrating another modified version of a stage of the apparatus of FIG. 1.

As explained hereinabove the stages illustrated in FIG. 1 employ an operational amplifier and components of appropriate value so as to produce substantially unity gain. With amounts of phase shift of up to 8° per stage as shown the changes in gain when the capacitor is connected and disconnected is not considered significant. With large shifts in phase, however, the amplitude variation of the signal when the capacitor is connected may become significant. FIG. 3 illustrates a modified stage in which the gain may be maintained at unity regardless of the amount of phase shift.

As illustrated in FIG. 3 the stage includes an operational amplifier 70 have its plus input connected directly to ground. Its minus input is connected through an input resistor 71. An input capacitor 72 is arranged so as to be switched into and out of the circuit by means of a digital switch 73 in the manner explained hereinabove. A feedback resistor 74 is connected betwen the output and the minus input of the operational amplifier 70. An additional resistor 75 is connected in series with the second digital switch 76 across the feedback resistor 74.

The switches 73 and 76 are controlled by the same CONTROL signal so that when the switches are open, only feedback resistor 74 is connected across the operational amplifier 70 and the stage operates to produce unity gain of the applied signal with no shifting in phase. When the switches 73 and 76 are closed, the capacitor 72 is connected in parallel with the input resistor 71 to produce an RC phase shifting network as explained hereinabove. At the same time the additional resistor 75 is connected in parallel with the feedback resistor 74. The value of resistor 75 is chosen so that the parallel combination of resistors 74 and 75 modifies the gain of the operational amplifier so as to cause the stage to produce unity gain.

While there have been shown and described what are considered preferred embodiments of the present invention, it will be obvious to those skilled in the art that various changes and modifications may be made therein without departing from the invention as defined by the appended claims.

What is claimed is:

1. Variable phase shifting apparatus including in combination an input terminal for receiving an AC signal;

an output terminal;

a plurality of signal conducting means connected in series between the input terminal and the output terminal for conducting an AC signal received at the input terminal to the output terminal;

each of said signal conducting means including circuit means, phase shifting means, and switching means operable when in a first state to connect the phase shifting means to the circuit means and operable when in a second state to disconnect the phase shifting means from the circuit means, the signal conducting means being operable to produce a predetermined phase shift in an AC signal conducted therethrough when the switching means is in said first state connecting the phase shifting means to the circuit means with respect to an AC signal conducted therethrough when the switching means is in said second state disconnecting the phase shifting means from the circuit means; and switch control means coupled to each of the switching means for selectively switching each of the switching means to said first or said second state;

at least one of said signal conducting means including a circuit means having an amplifier means and an input resistance connected thereto, the phase shifting means being a reactance element, and the switching means being operable when in said first state to connect the reactance element to the input resistance to provide a phase shifting network.

2. Variable phase shifting apparatus in accordance with claim 1 wherein each of the signal conducting means of said plurality is operable when its associated switching means is in said first state to shift the phase of an AC signal being conducted therethrough by a particular amount; and said switch control means is operable to cause the phase of an AC signal being conducted through the plurality of signal conducting means to be shifted by an amount equal to any one of a set of amounts of phase shift as provided by the possible combinations of first and second states of the switching means of the plurality of signal conducting means.

3. Variable phase shifting apparatus in accordance with claim 2 wherein each circuit means includes an operational amplifier;

the phase shifting means is a capacitance element; and each signal conducting means produces substantially unity gain for AC signals conducted therethrough.

4. Variable phase shifting apparatus in accordance with claim 2 wherein at least one of said signal conducting means includes additional resistance means, and additional switching means operable when in a first state to connect the additional resistance means to the amplifier means to modify the gain of the amplifier means and operable when in a second state to disconnect the additional resistance means from the amplifier means;

said switch control means being coupled to said additional switching means and being operable to switch the additional switching means to said first state when the first-mentioned switching means of the signal conducting means is switched to said first state and to switch the additional switching means to said second state when the first-mentioned switching means of the signal conducting means is switched to said second state.

5. Variable phase shifting apparatus including in combination an input terminal for receiving an AC signal;

an output terminal;

a plurality of signal conducting means connected in series between the input terminal and the output terminal for conducting an AC signal received at the input terminal to the output terminal;

each of said signal conducting means including circuit means, phase shifting means, and switching means operable when in a first state to connect the phase shifting means to the circuit means and operable when in a second state to disconnect the phase shifting means from the circuit means, the signal conducting means being operable to produce a predetermined phase shift in an AC signal conducted therethrough when the switching means is in said first state connecting the phase shifting means to the circuit means with respect to an AC signal conducted therethrough when the switching means is in said second state disconnecting the phase shifting means from the circuit means; and switch control means coupled to each of the switching means for selectively switching each of the switching means to said first or said second state;

at least one of said signal conducting means including a circuit means having an amplifier means and a feedback resistance connected between its output and input, the phase shifting means being a reactance element, and the switching means being operable when in said first state to connect the reactance element to the feedback resistance to provide a phase shifting network.

6. Variable phase shifting apparatus in accordance with claim 5 wherein each of the signal conducting means of said plurality is operable when its associated switching means is in said first state to shift the phase of an AC signal being conducted therethrough by a particular amount; and said switch control means is operable to cause the phase of an AC signal being conducted through the plurality of signal conducting means to be shifted by an amount equal to any of a set of amounts of phase shift as provided by the possible combinations of first and second states of the switching means of the plurality of signal conducting means.

7. Variable phase shifting apparatus in accordance with claim 6 wherein each circuit means includes an operational amplifier;

the phase shifting means is a capacitance element; and each signal conducting means produces substantially unity gain for AC signals conducted therethrough.

8. Variable phase shifting apparatus in accordance with claim 6 wherein at least one of said signal conducting means includes additional resistance means, and additional switching means operable when in a first state to connect the additional resistance means to the amplifier means to modify the gain of the amplifier means and operable when in a second state to disconnect the additional resistance means from the amplifier means;

said switch control means being coupled to said additional switching means and being operable to switch the additional switching means to said first state when the first-mentioned switching means of the signal conducting means is switched to said first state and to switch the additional switching means to said second state when the first-mentioned switching means of the signal conducting means is switched to said second state.

9. Variable phase shifting apparatus including in combination a first input terminal for receiving a first AC signal, a second input terminal for receiving a second AC signal;

a first output terminal;

a second output terminal;

a first plurality of signal conducting means connected in series between the first input terminal and the first output terminal for conducting a first AC signal received at the first input terminal to the first output terminal;

a second plurality of signal conducting means connected in series between the second input terminal and the second output terminal for conducting a second AC signal received at the second input terminal to the second output terminal;

each of said signal conducting means including circuit means having an amplifier means and a resistance connected thereto, phase shifting means comprising a reactance element, and switching means operable when in a first state to connect the reactance element to the resistance to provide a phase shifting network and operable when in a second state to disconnect the reactance element from the resistance, the signal conducting means being operable to produce a predetermined phase shift in an AC signal conducted therethrough when the switching means is in said first state connecting the reactance element to the resistance with respect to an AC signal conducted therethrough when the switching means is in said second state disconnecting the reactance element from the resistance, and switch control means coupled to each of the switching means of the first and second plurality of signal conducting means for selectively switching each of the switching means to said first or said second state whereby the phase relationship between the first and second AC signals at the first and second output terminals is selectively variable.

10. Variable phase shifting apparatus in accordance with claim 9 wherein certain of said circuit means include an operational amplifier having an input resistance connected thereto; and other of said circuit means include an operational amplifier having a feedback resistance connected between its output and input.

11. Variable phase shifting apparatus in accordance with claim 10 wherein each of the signal conducting means of said first and second plurality is operable when its associated switching means is in said first state to shift the phase of an AC signal being connected therethrough by a particular amount; and said switch control means is operable to cause the phase relationship between a first AC signal being conducted through the first plurality of signal conducting means and a second AC signal being conducted through the second plurality of signal conducting means to be shifted by an amount equal to one of a set of amounts of phase shift as provided by the possible combinations of first and second states of the switching means of the first and second pluralities of signal conducting means.

12. Variable phase shifting appartus in accordance with claim 11 wherein each phase shifting means is a capacitance element;

each signal conducting means produces substantially unity gain for AC signals conducted therethrough; and the amounts of phase shift produced by the signal conducting means of the first and second pluralities of signal conducting means being binarily related to provide a set of amounts of phase shift in which the amounts of the set differ by equal increments.

13. Variable phase shifting apparatus in accordance with claim 10 wherein at least one of said signal conducting means includes additional resistance means, and additional switching means operable when in a first state to connect the additional resistance means to the amplifier means to modify the gain of the amplifier means and operable when in a second state to disconnect the additional resistance means from the amplifier means;

said switch control means being coupled to said additional switching means and being operable to switch the additional switching means to said first state when the first-mentioned switching means of the signal conducting means is switched to said first state and to switch the additional switching means to said second state when the first-mentioned switching means of the signal conducting means is switched to said second state.

* * * * *